US007445452B1

(12) United States Patent
Wu

(10) Patent No.: US 7,445,452 B1
(45) Date of Patent: Nov. 4, 2008

(54) ELECTRICAL INTERCONNECTION SYSTEM HAVING MAGNETIC RETENTION DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/998,538

(22) Filed: Nov. 30, 2007

(51) Int. Cl.
*H01R 13/20* (2006.01)

(52) U.S. Cl. ..... 439/39; 439/607

(58) Field of Classification Search ..... 439/39, 439/607

See application file for complete search history.

(56) References Cited

U.S. PATENT DOCUMENTS

| | | | |
|---|---|---|---|
| 7,217,142 | B1 | 5/2007 | Wu |
| 7,247,046 | B1 | 7/2007 | Wu |
| 2007/0072443 | A1 | 3/2007 | Rohrbach et al. |

*Primary Examiner*—Briggitte R Hammond
(74) *Attorney, Agent, or Firm*—Wei Te Chung

(57) ABSTRACT

An electrical interconnection system includes a plug connector (1) and a receptacle connector (2). The plug connector (1) has an insulated housing (11); at least one terminal (12) received in the insulated housing (11); a spacer (15) defining a body segment and adjacent to the back face of the insulated housing, an attraction member defining a hollow portion to receive the insulated housing. The terminal has a mating portion (121) forward extending beyond a front face of the insulated housing, and a pair of tail portions (124) rearward extending beyond a back face of the insulated housing. One tail portion of the terminal is located on the body segment of the spacer and the other tail portion of the terminal is embedded in the body segment of the spacer. The receptacle connector (2) has an insulative housing (24); at least one contact (22) received in the insulative housing; a magnetic block (23) assembled to the insulative housing. The plug connector and the receptacle connector are securely coupled together via a magnetic attraction between the magnetic member and the attraction member thereof. The terminal of the plug connector contact the contact of the receptacle connector.

19 Claims, 11 Drawing Sheets

ELECTRICAL INTERCONNECTION SYSTEM HAVING MAGNETIC RETENTION DEVICE

CROSS-REFERENCE TO RELATED APPLICATION

This application is related to patent application Ser. No. 11/986,232, filed on Nov. 2, 2007, entitled "ELECTRICAL CONNECTOR ASSEMBLY WITH MAGNETIC RETENTION DEVICE", and it has the same applicant and assignee as the present invention. The disclosure of the related application is incorporated herein by reference.

BACKGROUND OF THE INVENTION

1. Field of the Invention

The present invention generally relates to an electrical interconnection system, and more particularly to an electrical interconnection system using magnetic attraction as retention means.

2. Description of Related Art

An electrical interconnection system is widely applied in electronic devices for signal transmission or power delivery. In order to prevent mated electrical connectors of the electrical interconnection system from being separated away from each other when they are in working status, a mechanism latch device is used to retain them together. However, the latch device may deformed if it is improperly used or some other reasons, thus the latch device couldn't ensure that the mated electrical connectors are coupled together securely.

U.S. Pat. Pub. No. 20070072443 disclose an electrical plug and receptacle relying on magnetic force to maintain contact. The plug and receptacle can be used as part of a power adapter for connecting an electronic device, such as a laptop computer, to a power supply. The plug includes electrical contacts, which are preferably biased toward corresponding contacts on the receptacle. The plug and receptacle each have a magnetic element. The magnetic element on one or both of the plug and receptacle can be a magnet, which is preferably a permanent rare earth magnet although electromagnets may also be used. The magnetic element on the plug or receptacle that does not include a magnet is composed of ferromagnetic material. When the plug and receptacle are brought into proximity, the magnetic attraction between the magnet and its complement, whether another magnet or a ferromagnetic material, maintains the contacts in an electrically conductive relationship. However, the structures of the referred plug connector and the receptacle connector are complex and difficult in assembling.

Hence, an improved electrical connector assembly is highly desired to overcome the disadvantages of the related art.

SUMMARY OF THE INVENTION

Accordingly, an object of the present invention is to provide an electrical interconnection system using a magnetic device as retention means.

In order to achieve the object set forth, an electrical interconnection system in accordance with the present invention comprises a plug connector and a receptacle connector. The plug connector comprises an insulated housing defining a number of terminal slots; a number of terminals received in the terminal slots, said each of the terminals has two tail portions disposed at different levels; an attraction member assembled to the insulated housing; a spacer assembled to a rear section of the insulated housing. The spacer defines a number of depression portions, said depression portions being separated into two distinct groups and arranged in both top section and bottom section of the spacer. Each of the terminals has one of the tail portions located in the depression portion. The receptacle connector comprising an insulative housing; a number of contacts received in the insulative housing; at least one magnetic block arranged around the insulative housing. The plug connector and the receptacle connector are securely coupled together by a magnetic attraction between the magnetic blocks and the attraction member. The contacts of the receptacle connector contact the terminals of the plug connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
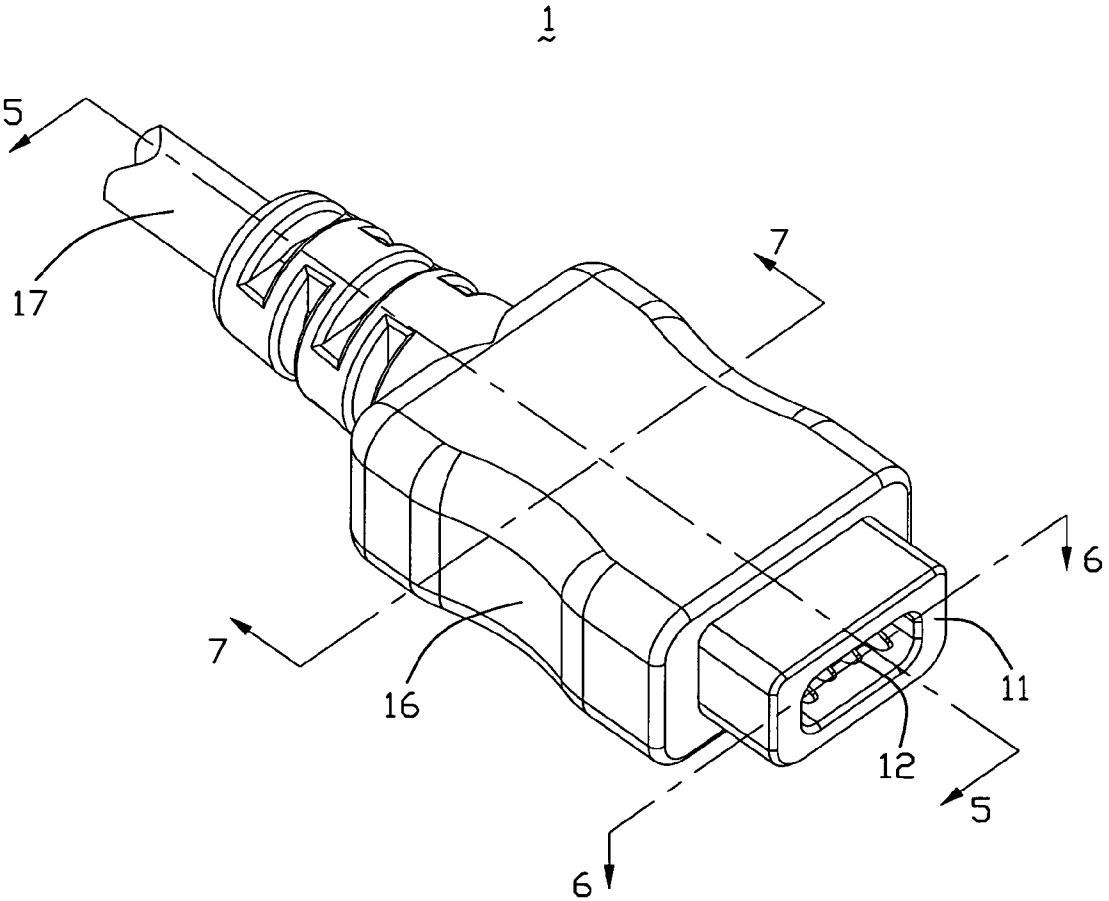
FIG. 1 is an assembled, perspective view of a plug connector for an electrical interconnection system in accordance with the present invention.
Figure 2:
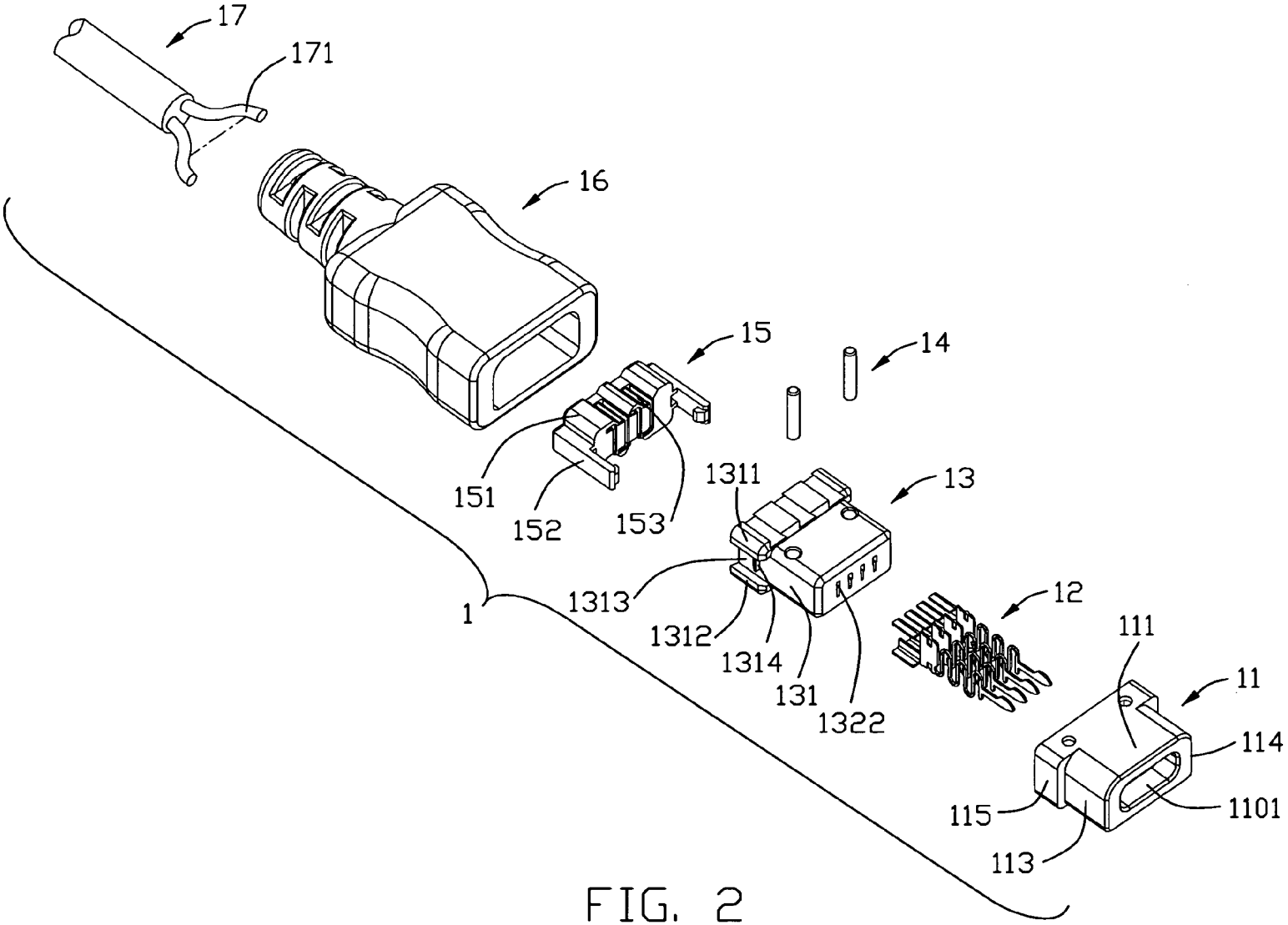
FIG. 2 is an exploded, perspective view of the plug connector.
Figure 3:
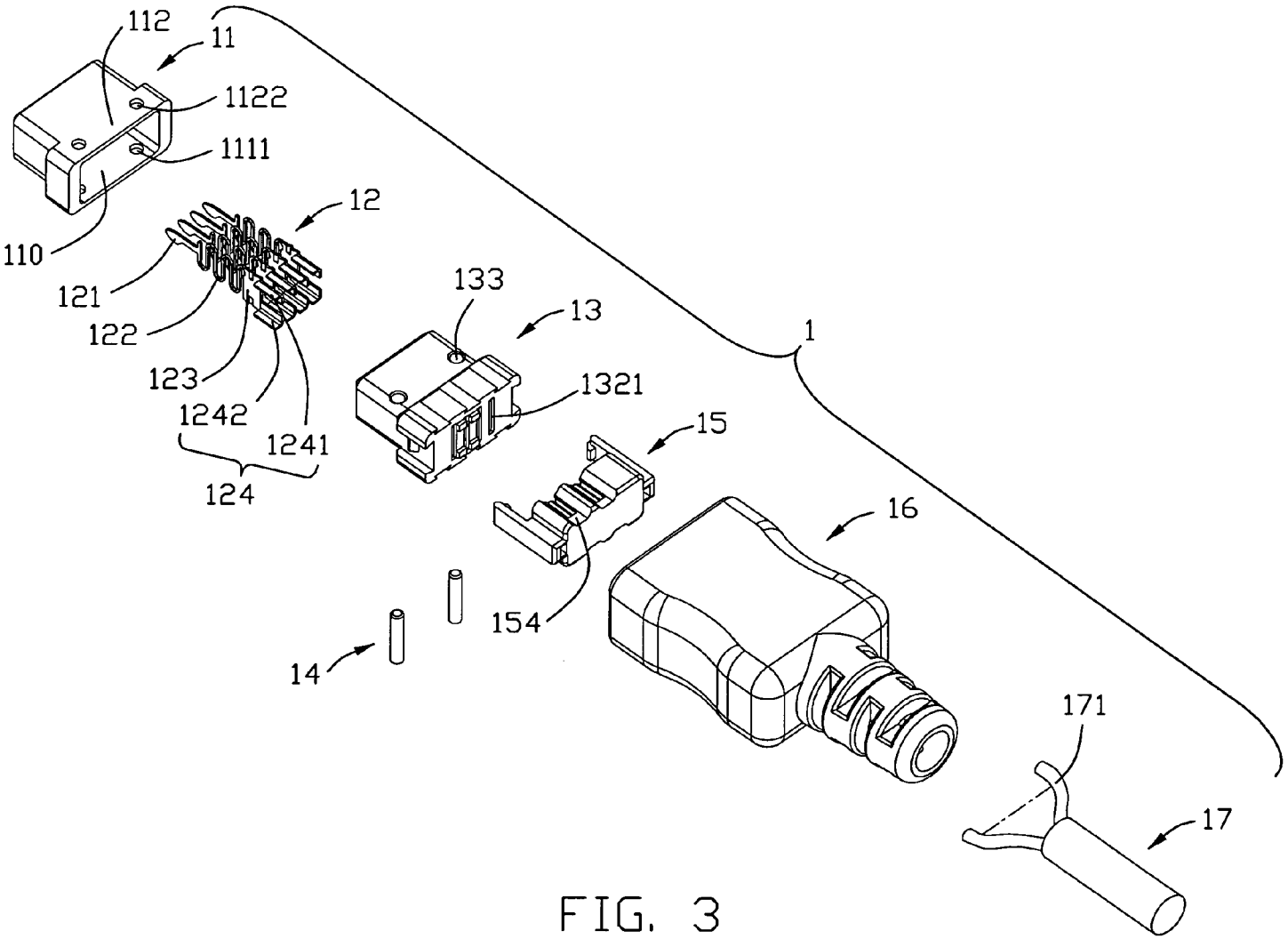
FIG. 3 is a view similar to FIG. 2, but viewed from another aspect.
Figure 4:
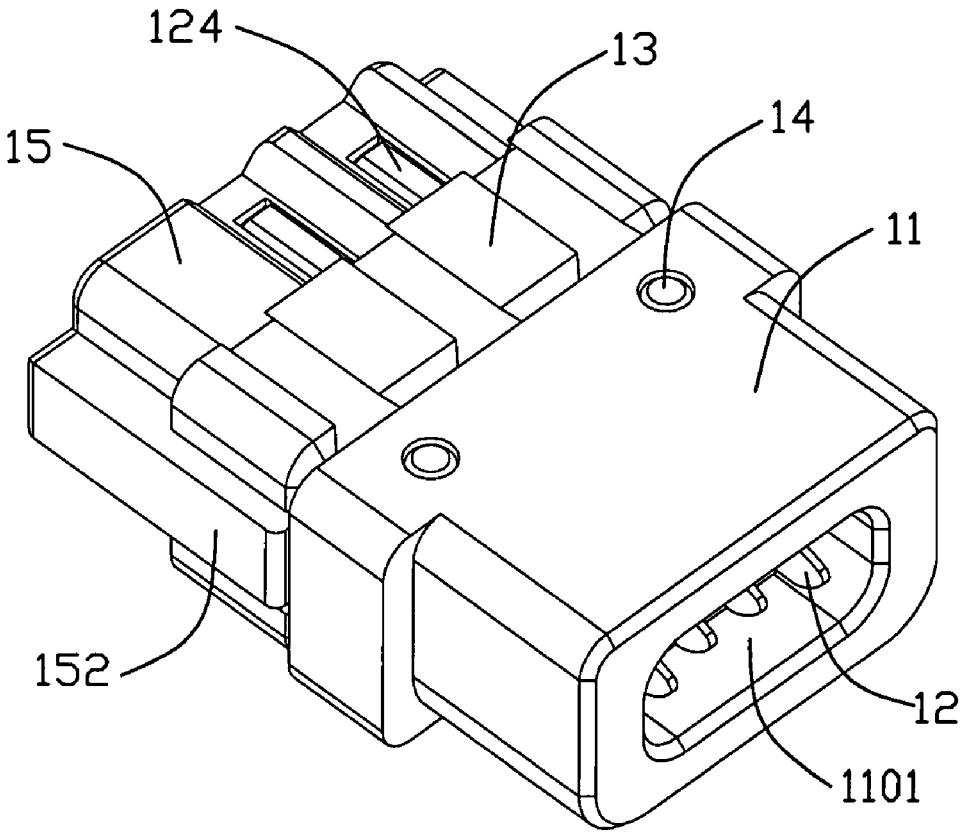
FIG. 4 is partially assembled, perspective view of the plug connector.
Figure 8:
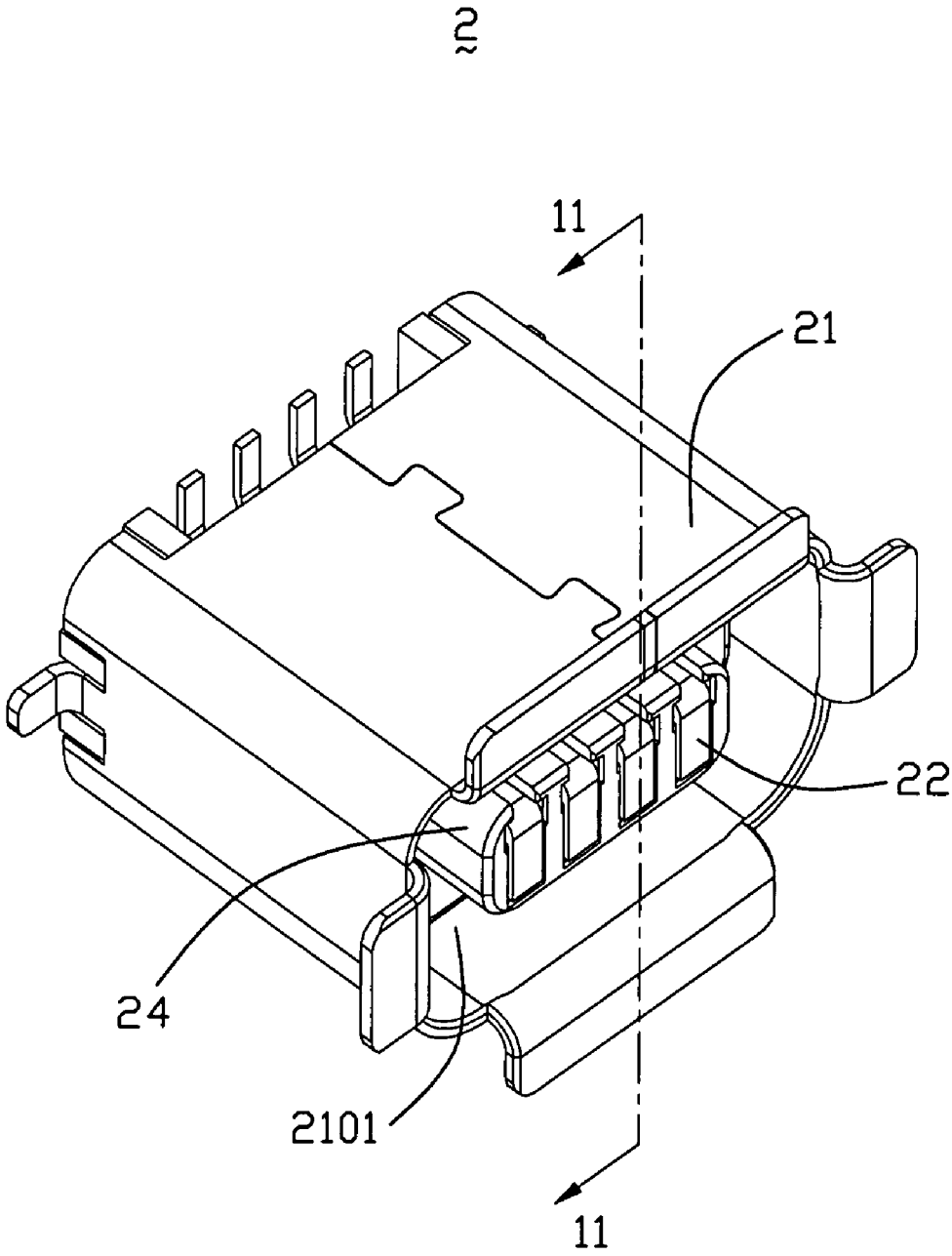
FIG. 8 is an assembled, perspective view of a receptacle connector for the electrical interconnection system in accordance with the present invention.
Figure 9:
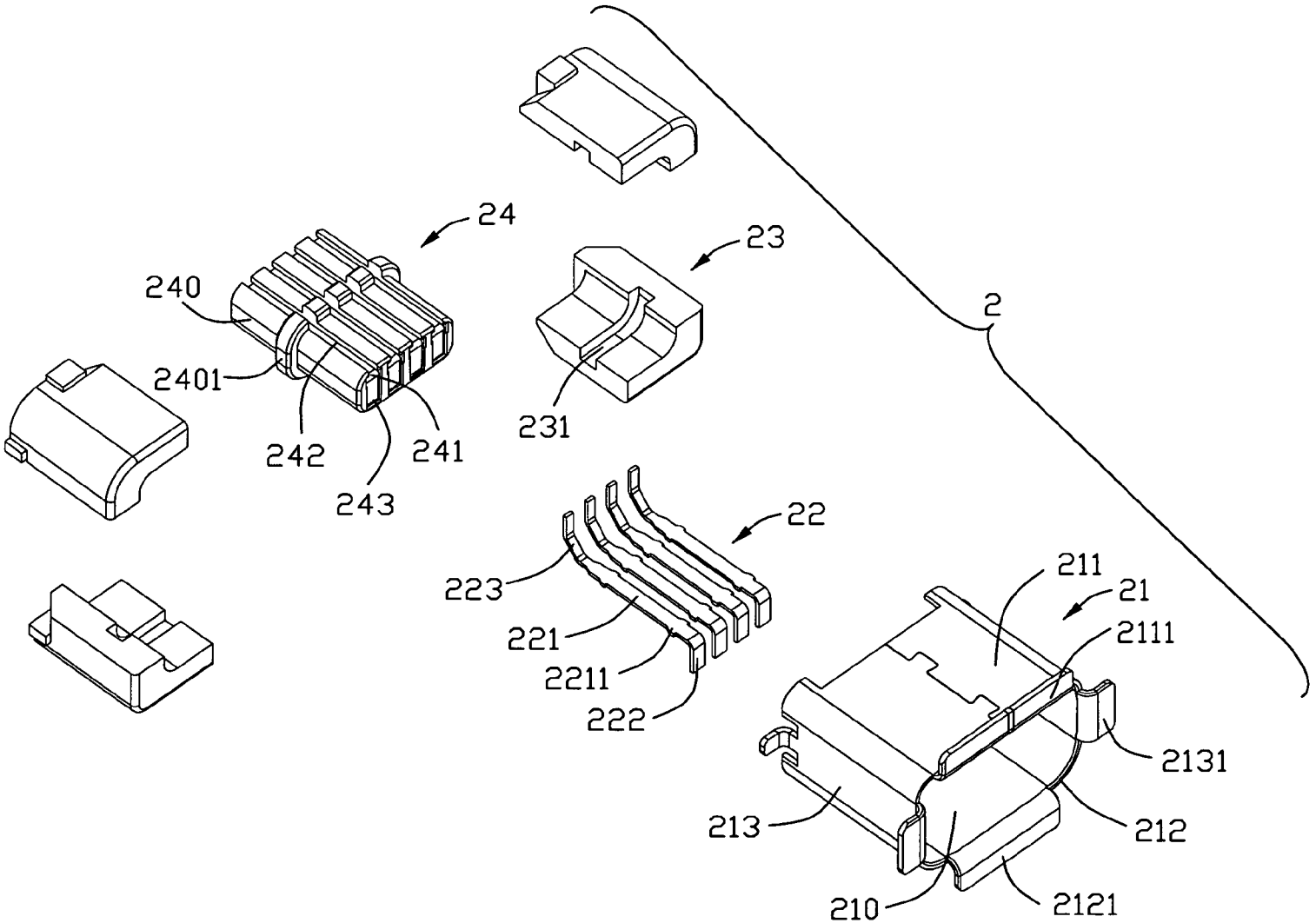
FIG. 9 is an exploded, perspective view of the receptacle connector.
Figure 10:
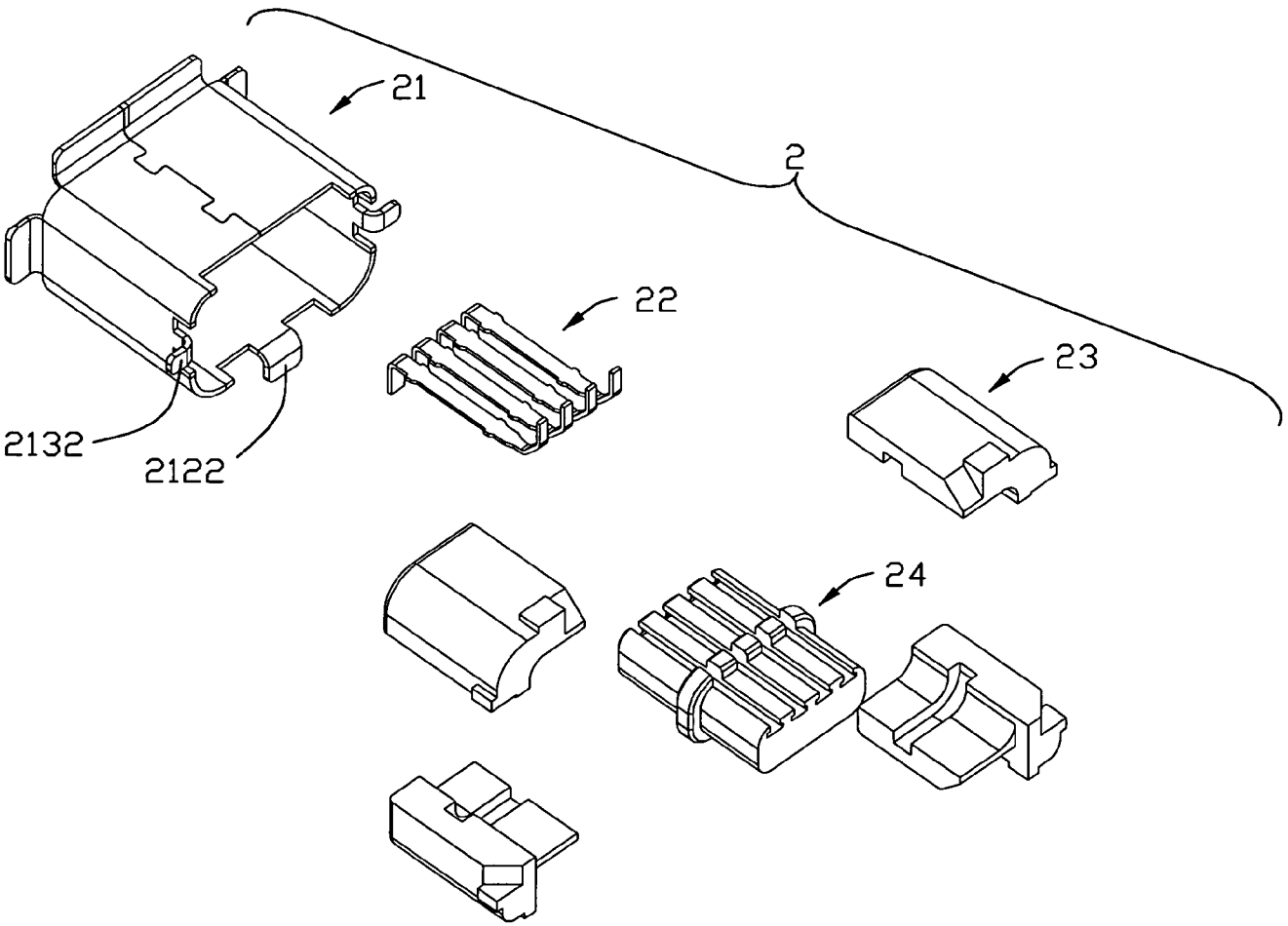
FIG. 10 is a view similar to FIG. 9, but viewed from another aspect.
Figure 11:
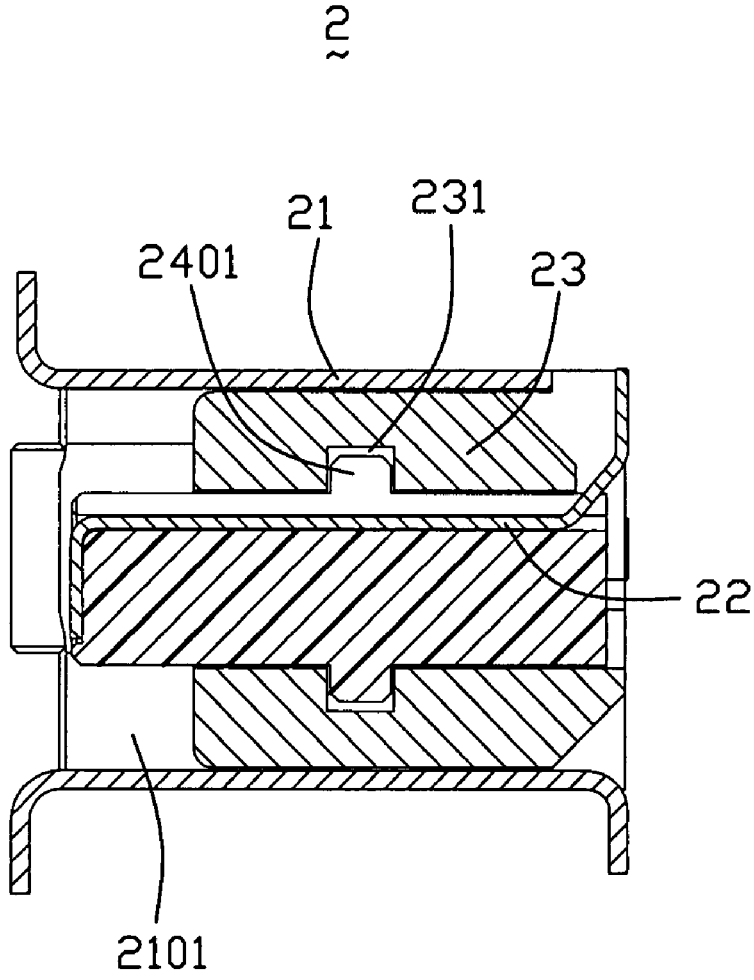
FIG. 11 is a cross-section view taken along line 11-11 of FIG. 8.

Referring to FIGS. 1 and 8, an electrical interconnection system (not numbered) comprises a plug connector 1 and a receptacle connector 2. The plug connector 1 and the receptacle connector 2 are coupled together via magnetic attraction therebetween. Both the plug connector 1 and the receptacle connector 2 are in accordance with Universal Serial Bus (USB) transmission standard.

Referring to FIGS. 1-5, the plug connector 1 comprises an attraction member 11, a number of spring terminals 12, an insulated housing 13, a spacer 15, a cover 16 and a cable 17.

The attraction member 11 is made of permanent magnet or ferromagnetic materials. The attraction member 11 is rectangular-shaped and comprises a top wall 111, a bottom wall 112 and a pair of transversal walls 113, 114 to corporately form a hollow portion 110 therebetween. The hollow portion 110 further has a narrow front outlet 1101 thereof. Each of the pair of the transversal walls 113, 114 further has a vertical protrusion member 115 located at rear section thereof. Both the top wall 111 and the bottom wall 112 define a pair of first through holes 1111, 1122 aligning with each other.

The insulated housing 13 comprises a rectangular-shaped body portion 131 defining a number of terminal slots 132 therein along a mating direction. Each terminal slot 132 includes a main terminal slot portion 1321 with a narrower front opening 1322. The insulated housing further has a pair of first protruding beams 1311 and a pair of second protruding beams 1312 respectively laterally extending outward from margin portions of a top and a bottom surface of a rear section thereof. The first protruding beam 1311 and the second protruding beam 1312 together with partial of lateral surface of the body portion 131 together form a guiding way 1313 thereamong. A tab 1314 is formed on the front section of the lateral surface within each guiding way 1313. A pair of second through holes 133 located at lateral sides of the middle section of the body portion 131 further pass top and bottom surfaces of the body portion 131. A front section of the body portion 131 is received in a rear portion of the hollow portion 110 of the attraction member 11. The pair of first through holes 1111, 1122 align with the pair of second through holes 133 to allow a pair of pin members 14 inserting into therein, thus the insulated housing 13 and the attraction member 11 are combined together securely.

Figure 5:
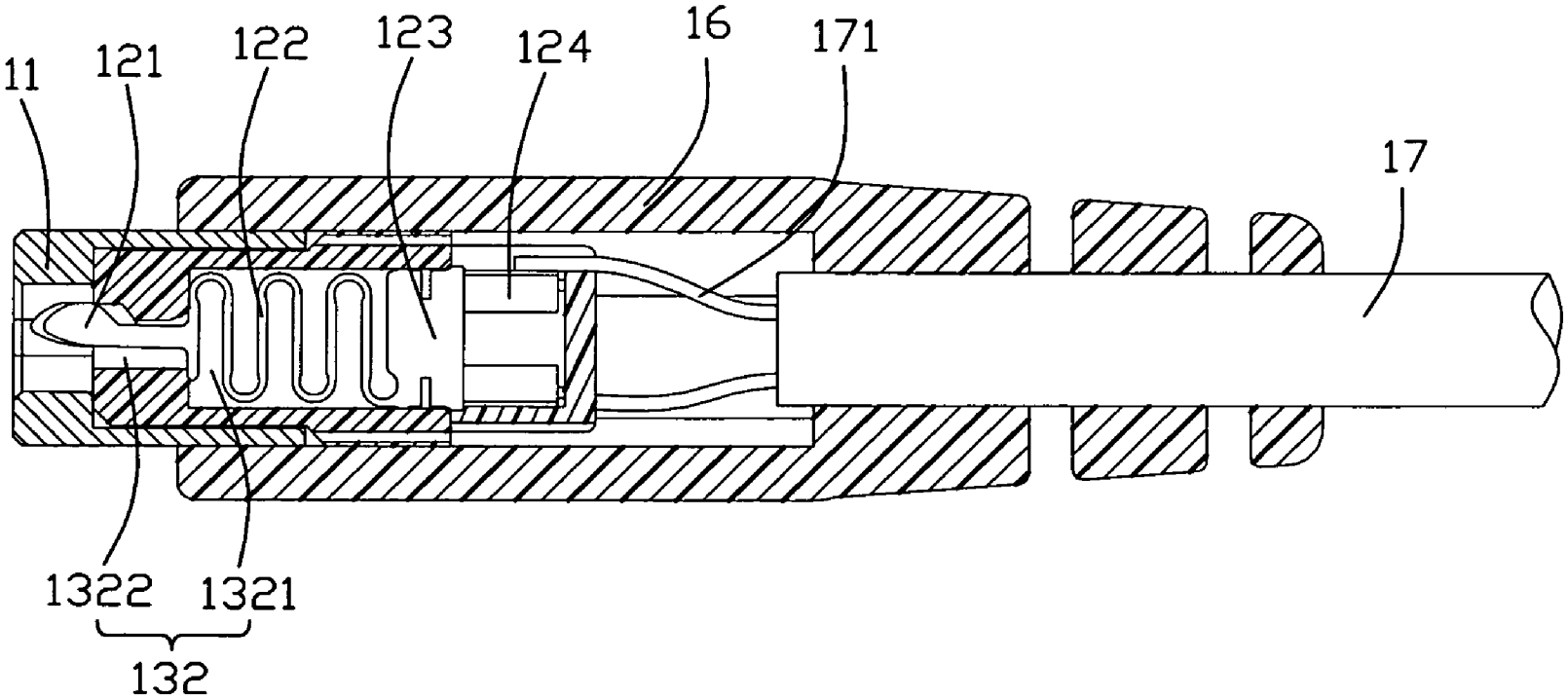
FIG. 5 is a cross-section view taken along line 5-5 of FIG. 1.
Figure 6:
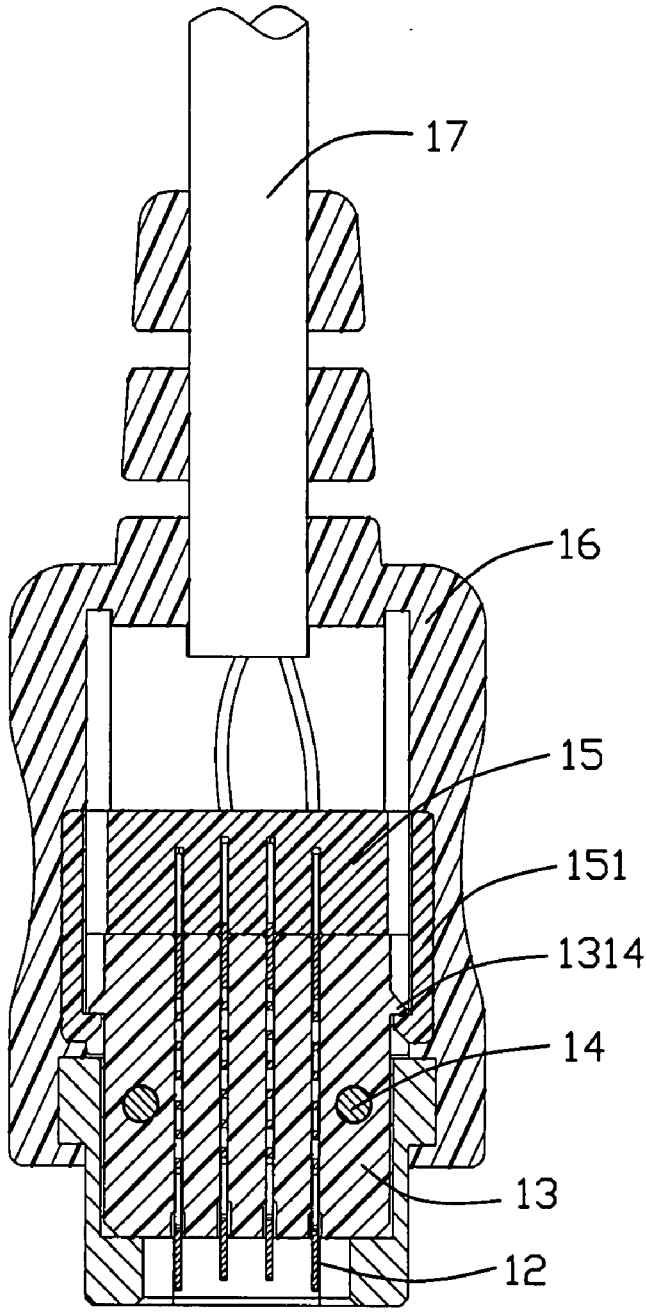
FIG. 6 is a cross-section view taken along line 6-6 of FIG. 1.
Figure 7:
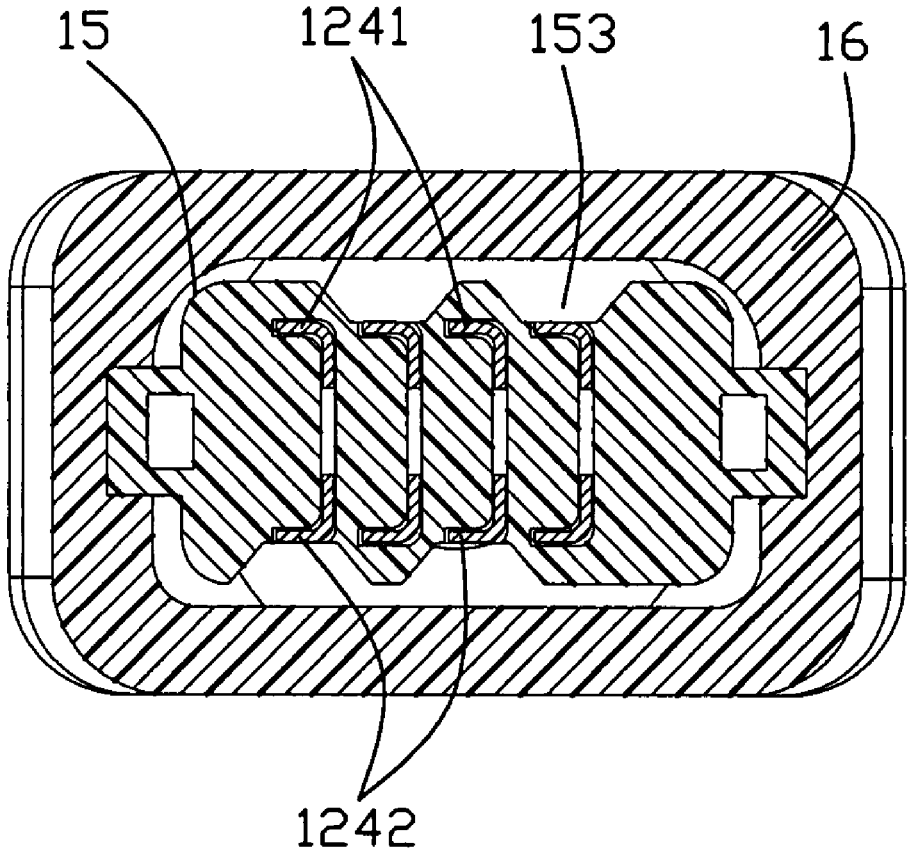
FIG. 7 is a cross-section view taken along line 7-7 of FIG. 1.

The terminals 12 are made of sheet metal and configured to spring-shaped. Each of the terminals 12 comprises a sinuate spring portion 122 having a number of U-shaped sections interconnecting with one another and lined along front-to-back direction, an expanded mating portion 121 extending forward from a front end portion of the sinuate spring portion 122, a flat retention portion 123 connecting to a rear end portion of the sinuate spring portion 122 and located in a vertical plane, a tail portion 124 coupled to rear section of the retention portion 123. The tail portion 124 has a pair of sub-segments which includes a first tail portion 1241 extending rearward from lower section of the retention portion 123, and a second tail portion 1242 extending rearward from upper section of the retention portion 123. The first tail portion 1241 face to the second tail portion 1242 along vertical direction. Either the first tail portion 1241 or the second tail portion 1242 has a horizontal segment (not numbered) and a vertical segment (not numbered) to configure L-shaped thereof. Referring to FIG. 5, the mating portion 121 of each terminal has a partially inclined end edge (not numbered), while the insulated housing 13 has its partial front section above each front opening 1322 cut to from an inclined lead-in portion (not numbered) facing to the inclined end edge of the mating portion 121 of each terminal 12. When the terminals 12 are assembled to the insulated housing 13, the mating portions 121 pass through the front opening 1322 of the terminal slots 132 and then extend beyond a front face of the insulated housing 13 and are disposed in a front portion of the hollow portion 110, the sinuate spring portions 122 are arranged in the main terminal slot portions 1321, the retention portions 123 are interferentially received in rear portions of the main terminal slot portions 1321 via barbs (not numbered) thereof, and the tail portions 124 are located outward of a back surface of the insulated housing 13.

Referring to FIGS. 2, 3, 4, 6 and 7, the spacer 15 comprises a body segment 151, a pair of latch arms 152 located at lateral sides of the body segment 151 and further forward extending to exceed a front surface thereof. The top surface of the body segment 151 defines a pair of separated first depression portions 153 along transversal direction, while the bottom surface of the body segment 151 also defines a pair of separated second depression portions 154 offset from the first depression portions 153 along vertical direction. The tail portions 124 is assembled to the spacer 15, with the first tail sections 1241 of the tail portions 124 (a first and a third ones, along front-to-left direction) embedded in the body segment 151, vertical portions of the second tail sections 1242 of the tail portions 124 also embedded in the body segment 151 and horizontal portions of the second tail portions 1242 arranged in the second depression portions 154; oppositely, the second tail portions 1242 of the tail portions 124 (a second and a fourth ones, along front-to-left direction) embedded in the body segment 151, vertical portions of the first tail portions 1241 of the tail portions 124 also embedded in the body segment 151 and horizontal portions of the second tail portions 1241 arranged in the first depression portions 154. The pair of latch arms 152 are inserted in the guiding ways 1313 and lock with the tabs 1314 thereof.

The cable 17 has a number of inner wires 171 soldered to corresponding tail portions 124 of the terminals 12, respectively. The cover 16 is plastic material and over molded on a forward section of the cable 17, the spacer 15, rear sections of the insulated housing 13 and the magnetic member 11.

Referring to FIGS. 8-11, the receptacle connector 2 adapted for mounting on a printed circuit board (not shown) comprises a metal shell 21, four magnetic blocks 23, and an insulative housing 24 and a number of contacts 22.

The insulative housing 24 has a main portion 240 with elliptic-shaped cross-section viewed from back. A loop flange portion 2401 encircles peripheral surface of a middle section of the main portion 240. A number of horizontal contact passages 241 aligned in a row along transversal direction are defined in a top section of the main portion 240. Further, a number of horizontal slits 242 are respectively defined in an upper surface of the main portion 240 to communicate with the contact passages 241. A number of vertical cavities 243 rearward recess form a front surface of the main portion 240 and further join to the contact passages 241, respectively.

Each contact 22 comprises a planar retention segment 221 with some barbs 2211 formed on a front and a back sections thereof, a vertical contacting segment 222 bent downward from front end of the retention segment 221, a rear connect segment 223 firstly rearward and upward slantly extending from back end of the retention segment 221, and then extending upward to form a substantially flat solder end. When the terminal 22 is assembled to the insulative housing 24, the retention segment 221 interferentially received in the contact passage 241, the vertical contacting segment 222 is arranged in the vertical cavity 243, and the rear connect segment 223 is disposed above a rear surface of the main portion 240.

Each of the magnetic blocks 23 is substantially L-shaped viewed along front-to-back direction and further has a positioning slot 231 located in a middle section of an inside surface thereof. The magnetic blocks 23 are symmetrically arranged outside of the main portion 240 of the insulative housing 24, with the flange portion 2401 protruding into the positioning slots 231 of the magnetic blocks 23. Every two adjacent magnetic blocks 23 attract each other, thus, they are combined together. The metal shell 21 is made of a single sheet metal with a receiving space 210. The magnetic blocks 23 are received in the receiving space 210 and bundled by the metal shell 21; therefore they are coupled together much securely. However, it is should be awared that in another alternative embodiment, two magnetic blocks or even one magnetic block may be available. While a front section of the insulative housing 24 protrudes forward to exceed front surfaces of the magnetic blocks 23, thus, a forward mating space 2101 is formed between the metal shell 21 and corresponding front section of the insulated housing 24. A front edge of the metal shell 21 forms two pairs of excurvate short sheets 2121, 2131 for guiding the plug connector 1 into mating with the receptacle connector 2. While a back edge of the metal shell 21 forms a number of tabs 2122, 2132 soldered to a printed circuit board (not shown).

Please refer to FIGS. 1 and 8, when the plug connector 1 mates with the receptacle connector 2, the front section of the insulative housing 24 inserts into front hollow portion 1101 of the hollow portion 110, while the front section of the attraction member 11 is received in the forward mating space 2101, and such configurations may ensure the plug connector 1 and the receptacle connector 2 mating with other properly. Via the magnetic attraction between the attraction member 11 and the magnetic blocks 23, the plug connector 1 and the receptacle connector 2 may coupled together securely. Further more, the mating portions 121 of the terminals 12 may wipe contacting segments 222 of the contacts to eliminate dust attached thereon, therefore, the plug connector 1 and the receptacle connector 2 may achieve better electrical connection therebetween.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A plug connector for an electrical interconnection system, comprising:

an attraction member defining a hollow portion;

an insulated housing received in the hollow portion of the attraction member, said insulated housing having a front face and a back face;

at least one terminal received in the insulated housing, said terminal having a mating portion forward extending beyond the front face of the insulated housing, and said the terminal having a pair of tail portions rearward extending beyond the back face of the insulated housing;

a spacer having a body segment and adjacent to the back face of the insulated housing; and wherein one tail portion of the terminal is located on the body segment of the spacer and the other tail portion of the terminal is embedded in the body segment of the spacer; wherein a front segment of the insulated housing is received in a rear segment of the hollow portion of the attraction member, wherein the mating portion of the terminal is disposed in a front portion of the hollow portion of the attraction member.

2. The plug connector as claimed in claim 1, wherein the terminal of the further comprises a spring body portion rearward extending from an end of the mating portion and an retention portion rearward extending from an end of the spring body portion.

3. The plug connector as claimed in claim 2, wherein the pair of tail portions extend rearward from back edge of the retention portion and apart from one another along vertical direction.

4. The plug connector as claimed in claim 2, wherein the spring body portion has a number of U-shaped members interconnecting with one another and lined along front-to-back direction.

5. The plug connector as claimed in claim 1, wherein the spacer latches with the insulated housing of the plug connector.

6. The plug connector as claimed in claim 5, wherein the spacer further comprises a pair of latch arms located at lateral sides of the body segment and extending to exceed a front surface thereof, wherein the pair of latch arms lock with a pair of tabs formed on lateral sides of the insulated housing, respectively.

7. The plug connector as claimed in claim 1, further comprising a cable having at least one inner wire electrically connecting to the tail portion of the terminal located on the body segment of the spacer.

8. An electrical interconnection system, comprising:

a plug connector including:

an insulated housing defining a number of terminal slots;

a number of terminals received in the terminal slots, said each of the terminals has two tail portions disposed at different levels;

an attraction member assembled to the insulated housing; and a receptacle connector including:

an insulative housing;

a number of contacts received in the insulative housing;

at least one magnetic block arranged around the insulative housing; and wherein the plug connector and the receptacle connector are securely coupled together by a magnetic attraction between the magnetic blocks and the attraction member;

wherein the contacts of the receptacle connector contact the terminals of the plug connector.

9. The electrical interconnection system as claimed in claim 8, further comprising a spacer assembled to a rear surface of the insulated housing.

10. The electrical interconnection system as claimed in claim 9, wherein the spacer defines a number of depression portions, separated into two distinct groups and arranged at top section and bottom section of the spacer, wherein one of the two tail portion of each of the terminals located in the depression portion.

11. The electrical interconnection system as claimed in claim 10, wherein every two adjacent terminals has their tail portions located in the depression portions being arranged at different levels.

12. The electrical interconnection system as claimed in claim 8, wherein the insulative housing of the receptacle connector has a number of horizontal contact passages defined in a top section of the main portion, wherein a front section of the insulative housing defines a number of vertical cavities join to the contact passages, respectively.

13. The electrical interconnection system as claimed in claim 12, wherein an upper surface of the main portion further defines a number of horizontal slits to communicate with the contact passages.

14. The electrical interconnection system as claimed in claim 12, wherein contacts comprises a retention segment received in the horizontal contact passage and a vertical contacting segment bent downward from front end of the retention segment and further received in the vertical cavities.

15. The electrical interconnection system as claimed in claim 8, wherein each of the magnetic blocks is configured to L-shaped and has a positioning slot located in an inside surface thereof, and wherein the insulative housing of the receptacle connector has a main portion forming a flange member thereon inserting into the positioning slot of the magnetic block.

16. The electrical interconnection system as claimed in claim 8, wherein a front section of the insulative housing of the receptacle connector protrudes forward of the magnetic blocks, wherein the receptacle connector further has a metal shell bundling around the magnetic blocks to form a forward mating space between the metal shell and the front section of the insulated housing, and wherein the front section of the attraction member of the plug connector is received in the forward mating space.

17. The electrical interconnection system as claimed in claim 16, wherein a front edge of the metal shell forms a number of excurvate short sheets guiding the plug connector into mating with receptacle connector.

18. A electrical connector assembly comprising:

a first connector including:

a first insulative housing;

a plurality of first contacts positioned in the first housing, each of said first contacts; has two tail portions disposed at different levels a magnetic structure surrounding the first housing;

a first metallic shell enclosing said magnetic structure;

a second connector mated with the first connector and including:

a second insulative housing receiving a plurality of second contacts and enclosed in a second metallic shell; wherein when mated, the second shell is urged to move toward the magnetic structure by magnetic forces in a mating direction so as to urge the first contacts engage the corresponding second contacts while the second contact result in a resilient force to push the front contact away in another direction opposite to said mating direction due to deflection of said second contact.

19. The electrical connector assembly as claimed in claim 18, wherein said first contacts are supported by the first housing not to be moved back during mating.

* * * * *